US005828015A

United States Patent [19]

Coulon

[11] Patent Number: 5,828,015

[45] Date of Patent: Oct. 27, 1998

[54] LOW PROFILE KEYBOARD KEYSWITCH USING A DOUBLE SCISSOR MOVEMENT

[75] Inventor: Kenneth E. Coulon, Plano, Tex.

[73] Assignee: Texas Instruments Incorporated, Dallas, Tex.

[21] Appl. No.: 829,912

[22] Filed: Mar. 27, 1997

[51] Int. Cl.[6] ..... H01H 13/70; H01H 3/12

[52] U.S. Cl. ..... 200/5 A; 200/343; 200/344

[58] Field of Search ..... 200/5 A, 341–345, 200/517; 361/680

[56] References Cited

U.S. PATENT DOCUMENTS

| | | | |
|---|---|---|---|
| 4,580,022 | 4/1986 | Olesch et al. | 200/344 |
| 5,329,084 | 7/1994 | Watanabe et al. | 200/344 |
| 5,457,297 | 10/1995 | Chen | 200/344 |
| 5,466,901 | 11/1995 | Mochizuki | 200/344 X |
| 5,504,283 | 4/1996 | Kako et al. | 200/5 A |
| 5,512,719 | 4/1996 | Okada et al. | 200/344 |
| 5,590,020 | 12/1996 | Sellers | 200/380 |
| 5,597,067 | 1/1997 | Yoneyama | 200/344 |

*Primary Examiner*—J. R. Scott

*Attorney, Agent, or Firm*—Bret J. Petersen; James C. Kesterson; Richard L. Donaldson

[57] ABSTRACT

A low profile and light weight keyboard for portable electronic devices, such as notebook computers having a dual scissor movement. In one embodiment, the movement comprises an inner 318 and outer member 333, which connect at four pivot points. The two scissors appear as adjacent portions of the inner and outer members which are connected at a pivot point 308, and connected to each other with "living hinges." 310 The inner and outer movement members are attached or bonded to the keycap 302 and base 312 with the living hinge 310.

21 Claims, 4 Drawing Sheets

FIG. 1
(PRIOR ART)
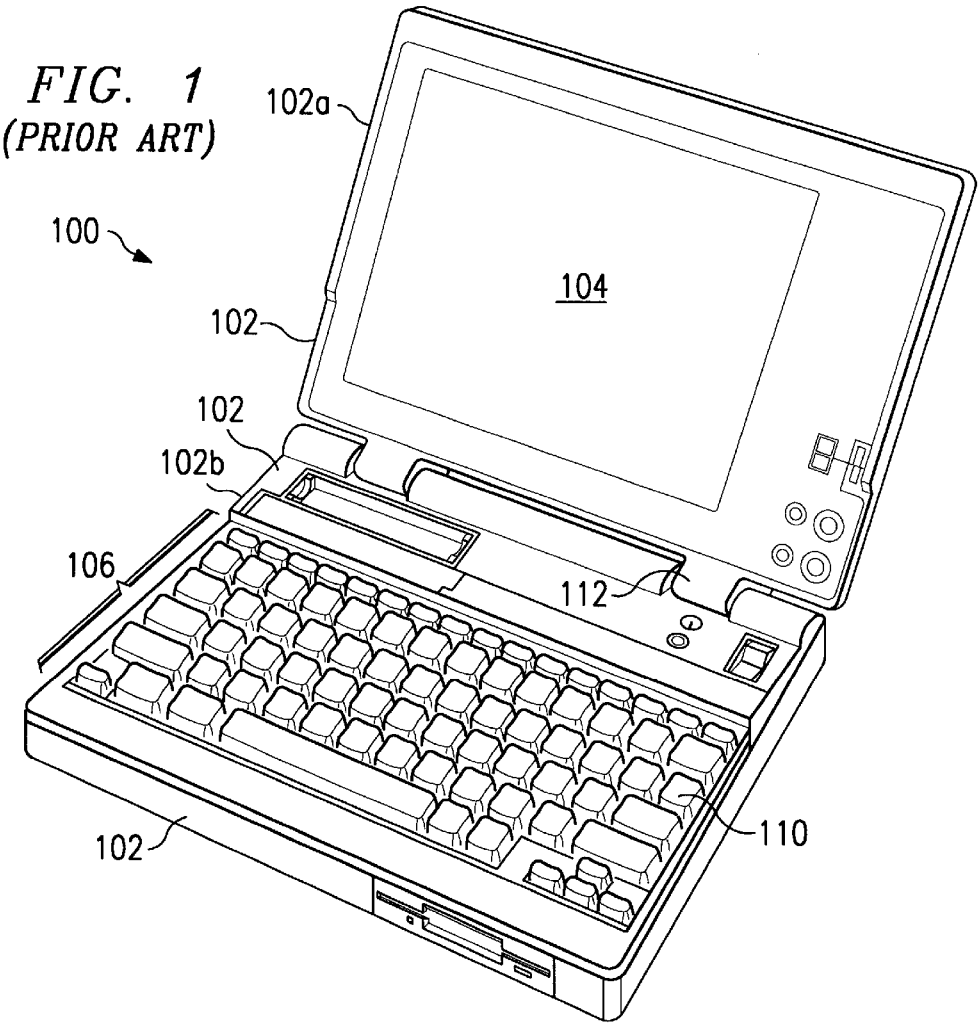
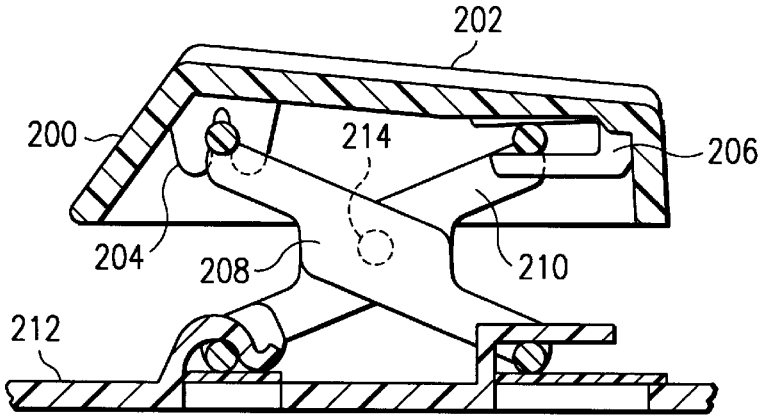
FIG. 2
(PRIOR ART)

LOW PROFILE KEYBOARD KEYSWITCH USING A DOUBLE SCISSOR MOVEMENT

FIELD OF THE INVENTION

This invention relates to keyboards and keyswitches, and more particularly, to a low profile keyboard which may be used in portable electronic devices such as laptops, notebooks, subnotebooks and pen computers, and other electronic keyboard machines requiring minimized dimensions. The keyboard and keys of the present invention utilize a new double scissor movement.

BACKGROUND OF THE INVENTION

Keyboards having keys or keyswitches are found on nearly every electronic device. Of particular interest herein are keyboards on portable electronic devices such as portable personal computers. Portable personal computers have developed from early luggable "suit case" designs, through smaller "laptop" designs, and now, with the aid of increasingly smaller packaging, to "notebook," "subnotebook" and personal digital assistants (PDAs), such as pen computers.

A "notebook" personal computer is about the size of a conventional loose leaf binder holding letter size paper, and typically weighs about 4–8 pounds. In contrast, PDAs are sometimes too small to incorporate a keyboard and therefore often use a pen as the main interface for input. PDAs may weigh less than one pound to about 3 pounds with a screen size of about 5 by 7 inches or smaller. Those portable computers having size, weight and performance lying between a notebook and a PDA are typically referred to as subnotebooks. In almost all portable notebook computer models, a keyboard compartment is hinged to a display screen compartment in such a manner that it is possible to fold the display screen compartment down against the keyboard compartment and to latch the two together, often referred to as a "clam shell" type enclosure. PDAs typically have a single enclosure rather than a hinged "clam shell" type with a screen on the top surface.

A significant portion of the thickness and weight of notebook and subnotebook computers resides in the keyboard. Low profile key switches are constantly being sought to reduce the height and weight of keyboards in portable personal computers. Additionally, it is important to users that a keyboard allow typing at a high speed, which renders two factors very important: (1) the depth or travel of a keystroke and (2) the feel of the key including the tactile sensation once the keystroke is complete.

Making thinner keyboards has often involved reducing the depth of the keystroke. Reducing the depth of the keystroke to less than three millimeters, however, is unacceptable to many users. A keystroke depth of four millimeters is favored by most users, particularly touch typists, because it is similar in feel to a desktop computer keyboard. Accordingly, notebook computers which reduce keyboard height by reducing the depth of the keystroke are likely to be disfavored by many touch typists.

In several prior art patents, e.g. U.S. Pat. Nos. 4,580,022 and 5,466,901, both incorporated herein by reference, key movements are disclosed which have a scissor mechanism to guide the keytop and press a dome shaped elastomer spring. The springs have a conductive contact surface on the underside of the dome which makes contact with electrical traces on a base or circuit board to signal to the computer the key has been pressed. While these designs have been successful, there are difficulties with extending them to lower profile keyboard keyswitches.

SUMMARY OF THE INVENTION

The present invention allows extending the scissor type movement beyond the limits of the prior art to achieve a lighter and thinner keyboard for portable electronic devices, such as notebook computers. As keyswitches become very low in profile (<3 mm in height) the scissor designs of the prior art would require movement arms which are very short or thin due to the lower profile, but the same length as before to provide the same stability or wobble control. Thus the prior art design would require long, thin arms, which are too weak to build a lower profile keyboard having sufficient key travel. By dividing the single scissors into two scissors, the length-to-height ratio of the scissors arms can be maintained the same as prior art designs with increased strength and other advantages outlined below.

In an embodiment of the invention, a low profile keyboard keyswitch is described which has a dual scissor movement or guiding mechanism made from only two pieces, an inner and an outer member, where the two members connect at four pivot points. The two scissors appear as adjacent portions of the inner and outer members which are connected at a pivot point using pins molded into the inner members, and connected to each other with "living hinges." The inner and outer movement members are bonded or captivated to a keycap and a base respectively at the living hinges. The far ends of the outer two scissors arms slide on the bottom of the keycap until they are stopped and captured by the angled stops molded in to the keycap. This novel design has several advantages over the prior art designs. For example, the parts count is reduced, and the delicate piece parts of the prior art are replaced with more robust and maufacturable pieces.

In another embodiment, a low profile keyboard keyswitch is described in which a clip is molded in the keycap to capture the inside scissors living hinge section to connect the inner ends of the inside scissors arms to the keycap. This allows the easy assembly since the keycap is self aligning and can be snapped in place.

An advantage of the present invention is the portion of the movement member or the keycap which contacts the flexible dome moves vertically. In contrast, the portion of the movement member which depressed the flexible dome in prior art had some lateral movement. This lateral movement greatly increased the complexity of the movement member and the flexible dome necessary to achieve an acceptable dome collapse to give proper tactile response and key return.

Another advantage of the present invention is the flexible dome can be compressed with the keycap, or with a central platform such that the flexible dome is only one-half the height of the key travel.

BRIEF DESCRIPTION OF THE DRAWINGS

The novel features believed characteristic of the invention are set forth in the appended claims. The invention itself, however, as well as other features and advantages thereof, will be best understood by reference to the detailed description which follows, read in conjunction with the accompanying drawings, wherein:

FIG. 1 represents a typical notebook computer of the prior art;

FIG. 2 represents a cross-sectional view of a keyboard key used in computers of the prior art shown in FIG. 1 and includes a scissor movement;

DETAILED DESCRIPTION OF THE PREFERRED EMBODIMENTS

Figure 3:
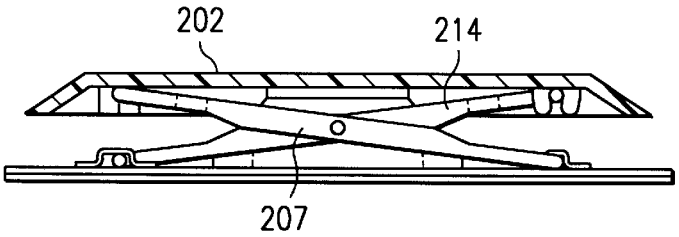
FIG. 3 (PRIOR ART)
FIG. 3 represents a cross-sectional view of a low profile keyboard key according to the prior art.

The preferred embodiments of the present invention are best understood by referring to FIGS. 1–10*b* of the drawings.

With reference to FIG. 1, there is shown a prior art portable computer 100 of the type commonly referred to as a notebook computer or laptop computer. Computer 100 includes a housing 102 which is a clamshell type enclosure which includes a top 102*a* and bottom 102*b* portion. The top housing portion 102*a* includes a display 104, and the bottom housing portion 102*b* has a keyboard 106, which includes keys, only the keycaps 110 of which are visible. The two housings portions 102*a*, 102*b* are connected along one edge with a hinge 112 for pivotal movement relative to each other to expose the keyboard 106 and display 104 during use. In order to reduce the overall thickness of the combined housings portions 102*a*, 102*b* it is desirable to reduce the thickness of the keyboard and its associated housing portion 102*b*.

An example of a prior art keyboard key 200 is illustrated in FIG. 2 which represents a cross section of a scissor movement type key. This type of key 200 includes a keycap 202, having retainers 204 and 206 which engage a scissor movement 207 having an outer arm 208 and an inner arm 210. Each end of each arm 208, 210 is connected to either the key cap 202 by the retainers 204, 206 or a base 212. Typically, one end of each movement arm is held fixed and the other slides in a guide in the keycap or base. The two scissor arms pivot about a center shaft 214. A pair of scissor movement arms are typically found on either side of the key, although only a single pair is illustrated in FIG. 2. A flexible spring or dome, not shown, is located beneath the keycap and between the two pair of scissor movements includes a conductive contact on its underside. When the key is depressed, the conductive contact on the dome make contact with electrical traces on a circuit board associated with the base 212 to provide the electrical signal to the computer electronics that the key has been depressed. The dome or spring then returns the key to the up or non-depressed position shown in FIG. 2.

FIG. 3 represents a key according to the prior art illustrated in FIG. 2 but with a much lower profile. As keyswitches become very low in profile (less than about 5 mm in height) the scissor designs of the prior art would require movement arms which are very short in height or thin due to the reduced height of the key, but the same length as before to provide the same stability or anti-wobble. As can be seen in FIG. 3, the height of the arms in the area shown 214 must be thin and very long compared to the height of the prior art design in FIG. 2. Therefore, the prior art scissor movement design would require long thin arms to build a lower profile keyboard having sufficient key travel. Scissor movement arms as shown in FIG. 3 would be difficult to manufacture with sufficient strength to make a suitable keyswitch. By dividing the single scissors into two scissors according to the present invention, the length to height ratio of the scissor arms for a low profile key can be significantly higher, the same or approaching prior art designs, thus retaining the necessary robustness in addition to the other advantages outlined below.

Figure 4:
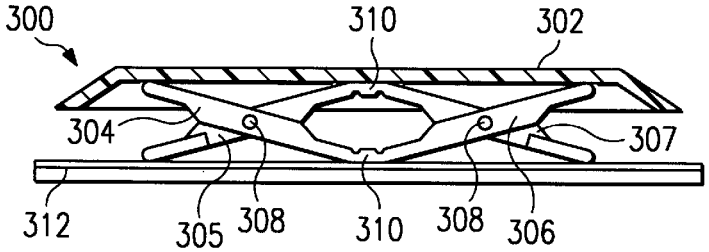
FIG. 4 represents a cross-sectional view of a keyboard key of a preferred embodiment of the present invention, the key utilizing a dual scissor movement.

An embodiment of the present invention is illustrated in FIG. 4, which represents a cross sectional side view of a keyswitch 300, having a portion of keycap 302 cutaway. This embodiment includes a low profile keyboard keyswitch having a dual scissor movement with a key cap 302. The dual scissor movement includes two scissor mechanisms similar to the prior art single scissor, with two scissors on each side of the key. FIG. 4 shows only one of two dual scissor mechanisms that are typically employed for each key.

Again referring to FIG. 4, the left scissor has an outer arm 304 and an inner arm 305. The right scissor has an outer arm 306 and an inner arm 307. The two arms of each scissor rotate about a pivot 308. Each of the scissor arms has a top end and a bottom end. While not necessary to the present invention, in the illustrated embodiment, arms of the two scissors are integral at the center 310. The inner arms 305, 307 are connected to the underside of the keycap 302. The outer arms 304, 306 are similarly connected at the bottom of the key and to the base 312. Typically, one end of each movement arm is held fixed and the other slides in a guide in the keycap or base. In the illustrated embodiment, the arms are held fixed at the center common points shown at 310. The two scissor arms of each scissor mechanism pivot about a center shaft 308. A pair of scissor movement arms are typically found on either side of the key, although only a single pair is illustrated in FIG. 2. When the key is depressed, contacts on a flexible dome, located beneath the keycap and between the two pair of scissor movements but not shown, make contact with electrical traces on a circuit board associated with the base 312 to provide the electrical signal to the computer electronics that the key has been depressed.

Figure 5:
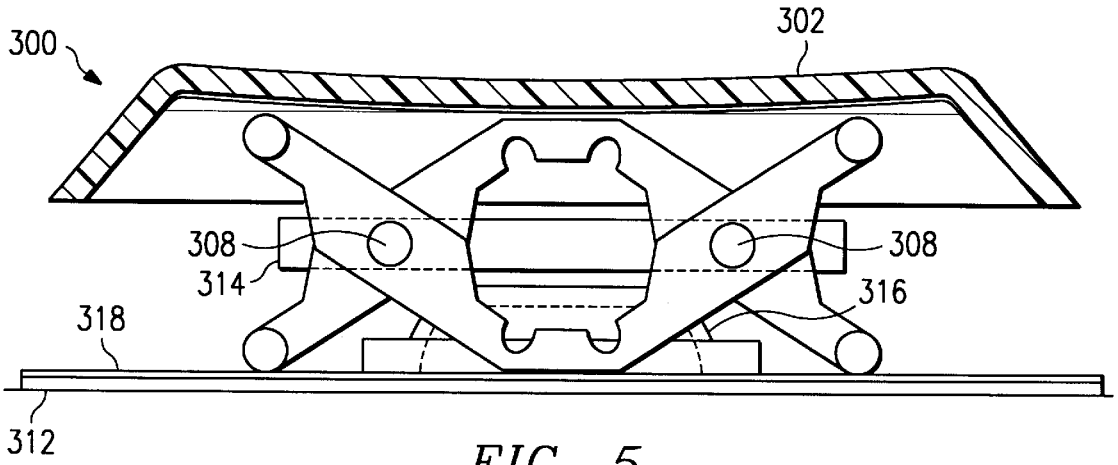
FIG. 5 represents a cross-sectional view of a keyboard key of another preferred embodiment of the present invention where the dome is depressed by a central platform member.

Another embodiment of the present invention is illustrated in FIG. 5 which represents a cross section of a double scissor key. This embodiment shows further structure added to the embodiment of FIG. 4, a plate 314, which pushes against the dome 316 to make the electrical contact on the PWB 318. The horizontal plate 314 is preferably connected to each of the four scissor pivot points 308 as illustrated further in FIGS. 6–9. As in the prior art, the dome or spring 316, includes contacts (not shown) on the underside to make contact with a set of conductive traces (not shown) on the PWB 318. This embodiment is particularly suited for taller keys, those having a height of greater than about 5 mm. The plate 314 allows for a shorter flexible dome, since a tall flexible dome with a typical height to diameter ratio would be too large to easily fit under the keycap. The horizontal plate also has advantages over the prior art. Prior art keys typically had plates which did not move in a completely vertical direction, causing difficult flexible dome designs to compensate for the lateral or horizontal movement of the plate. Advantageously, the plate 314 of the illustrated embodiment moves in a completely vertical direction when the key is depressed.

Figure 6:
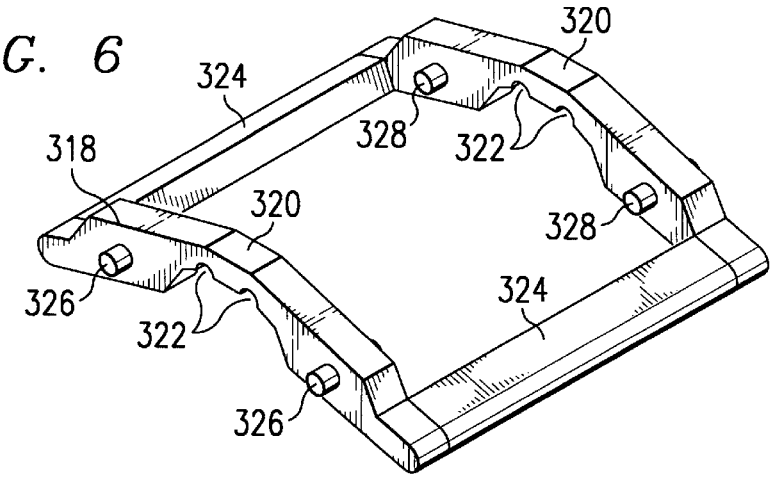
FIG. 6 represents a perspective view of an upper movement member.
Figure 7:
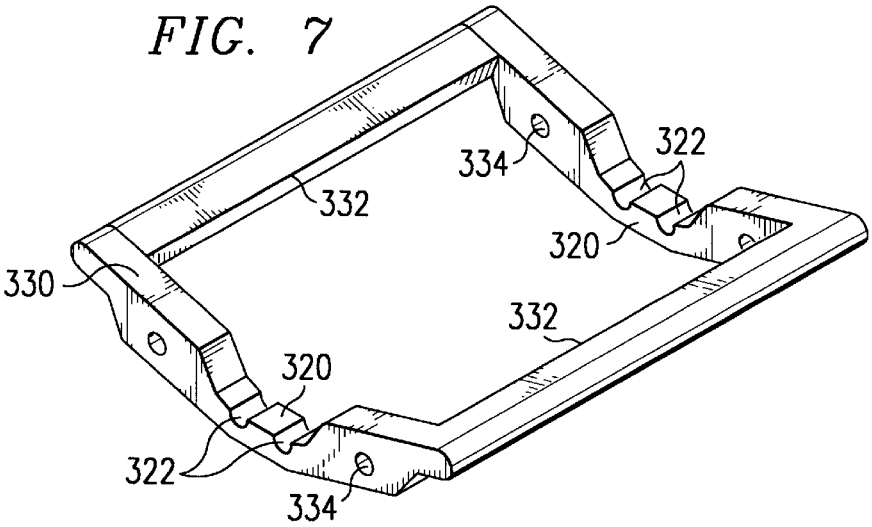
FIG. 7 represents a perspective view of a lower movement member.
Figure 8:
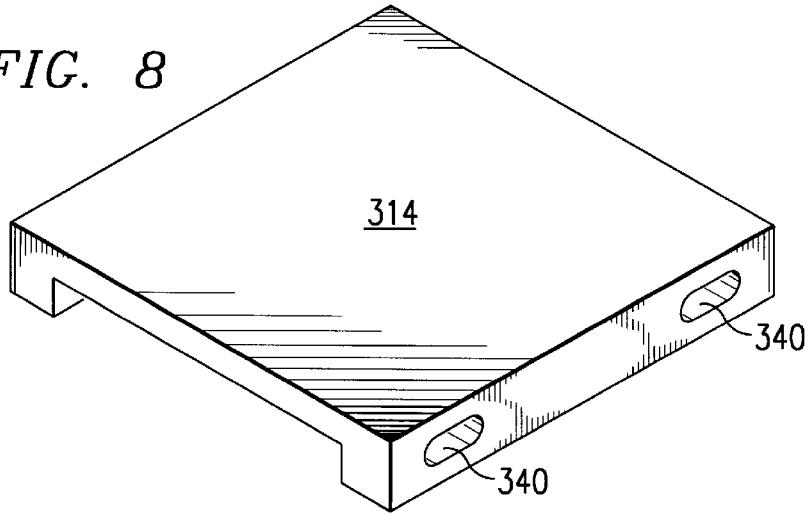
FIG. 8 represents a perspective view of a platform member.

Other embodiments of the present invention are shown in FIGS. 6–9. In these figures, a preferred embodiment is shown which incorporates the features and advantages discussed above into a simple to manufacture and low parts count solution to a low profile key. In a preferred embodiment, the inner arms of all four scissors for a single key are molded into a single piece, shown in FIG. 6, and the outer arms of all four scissors are molded into a second piece, shown in FIG. 7. The plate which connects to the scissor pivot points is shown in FIG. 8. The three piece parts of a single key movement mechanism are shown in a combined side view in FIG. 9.

FIG. 6 is a perspective view of an inner arm structure 318 for a preferred embodiment. The inner arm structure 318 makes up the four inner arms of the two sets of dual scissors for a single key as discussed above. The inner arm structure 318 is a substantially rectangular member which is open in the center. Two sides of the member make up the four inner arms, each pair separated by a living hinge portion 320 having two cuts 322 to form two living hinges for movement of the key. The other two sides of the inner arm structure 318 form slide feet 324 which slide along the key base as the key is depressed. The inner arm structure also has pivot shafts 326 preferably integrally molded with the member and located intermediate the living hinge 320 and the slide ends of the arms.

FIG. 7 is a perspective view of an outer arm structure 330 for a preferred embodiment. The outer arm structure 330 makes up the four outer arms of the two sets of dual scissors for a single key as discussed above. The outer arm structure 330 is also a substantially rectangular member which is open in the center. Two sides of the member make up the four outer arms, separated by a living hinge portion 320 having two cuts 322 to form two living hinges for movement of the key. The other two sides of the outer arm structure 330 form slide feet 332 which slide along the key cap as the key is depressed. The outer arm structure has pivot shafts openings 334 for engaging corresponding pivot shafts 326 in the inner arm structure illustrated in FIG. 6.

FIG. 8 is a perspective view of the platform structure 314 for a preferred embodiment. In this embodiment, the platform is a rectangular member with a solid top face for engaging the flexible dome 316 shown in FIG. 5. The platform includes openings 340, or other means for engaging the inner scissor mechanism. When a platform is used, the inner arm structure preferably includes platform shafts 328 on the inner portion of the structure for engaging corresponding openings in the platform illustrated in FIG. 8. The points of engagement on the inner scissor mechanism are preferably at the pivot points of the scissors so that the platform will move in a completely vertical path (with respect to the plane of the keyboard base) when the key is depressed. The platform openings 340 are elongated in the illustrated embodiment to allow for travel of the platform shafts when the key is depressed.

Figure 9:
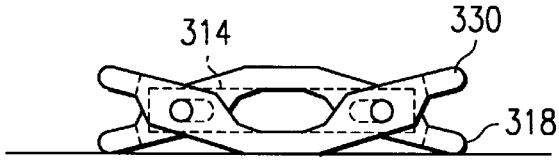
FIG. 9 represents a side-view of an embodiment having the movement members of FIGS. 6–8.

FIG. 9 illustrates a side view of the three piece parts of a single key movement mechanism discussed in relation to FIGS. 6–8.

Figure 10A:
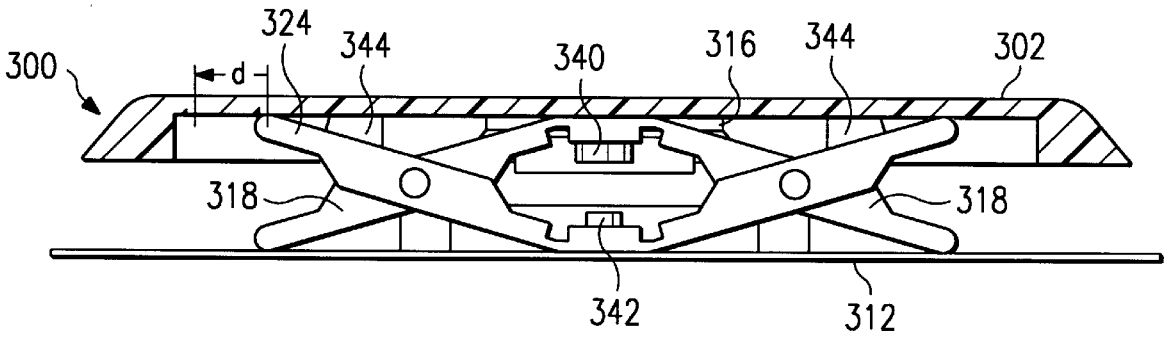
FIG. 10*a* represents a front-view of another embodiment.
Figure 10B:
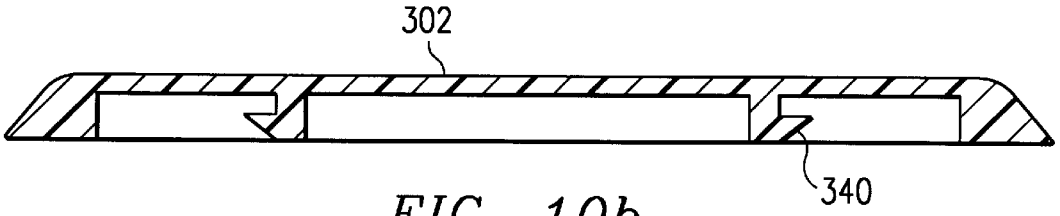
FIG. 10*b* represents a side-view of a portion of the keycap illustrated in FIG. 10*a* to show keycap retaining clips.

FIG. 10*a* illustrates a front view of another preferred embodiment. In this preferred embodiment, the assembly of the keyboard key is simplified by forming clips 340 on the keycap 302 which engage the inner scissor structure 318 so the keycap can be snapped into place. Similarly, FIG. 10*b* illustrates a side view of keycap 302 to illustrate a side view of clip 340. Likewise, it is preferable that the keyboard base 312 have clips 342 to retain the outer scissor structure also at the living hinge member. In the alternative, the outer scissor members of the keyboard could be adhesively attached to the base with a positioning jig or by automated means. Further, the outer scissor members of the keyboard could include protrusions that fit in corresponding holes in the base and adhesively fixed in place or the protrusions used as a rivet.

Again referring to FIG. 10*a*, the keycap 302 also preferably utilizes a keystop structure 344 which holds the key at the top of its travel by engaging a portion of the slide feet 324. When a key is depressed by the user, the slide feet 324 slide a distance "d" along the keycap 302 as shown in FIG. 10*a*. When the key is released, the slide feet 324 return along the keycap 302 come to a resting position impinging against keystop structure 344. As in the prior art, the return force is provided by an elastomer dome or spring 316. The flexible dome 316 pushes keycap 302 upwards and the keycap clip 340 in turn pulls upward on inner scissor structure 318 to return the keyswitch to the non-depressed position illustrated in FIG. 10*a*.

While this invention has been described with reference to illustrative embodiments, this description is not intended to be construed in a limiting sense. Various modifications and combinations of the illustrative embodiments, as well as other embodiments of the invention, will be apparent to persons skilled in the art upon reference to the description. It is therefore intended that the appended claims encompass any such modifications or embodiments. For example, the pivot shafts could be incorporated with the outer arm member rather than the inner member. The platform could also have other means of attaching to the inner scissor mechanism, such as pins rather than slots. Also, the shape of the platform need not be rectangular.

What is claimed is:

1. A portable electronic device comprising:

a. a housing;

b. a low profile keyboard associated with said housing comprising a plurality of keyswitches, each keyswitch having a keycap which moves towards a base in response to a keystroke by a user to compress for generating an electrical signal, wherein the improvement comprises:

a dual scissors movement for at least one of said keyswitches having two scissor structures on each of two sides of said keyswitches, where each scissor structure has a pivot point and at least two arms which pivot about said pivot point, and one or more ends of said arms connected to said key cap and said base layer.

2. The electronic device of claim 1, wherein said dual scissors movement further comprises a living hinge to connect at least one of said arms to said base.

3. The electronic device of claim 1, wherein said dual scissors movement comprises an inner and outer arm member which in combination provides a dual scissors movement for at least two sides of said key.

4. The electronic device of claim 2, wherein said dual scissors movement comprises an inner and outer arm member which in combination provides a dual scissors movement for at least two sides of said key.

5. The electronic device of claim 1, further comprising a central platform located between said base and said keycap for pressing said flexible dome when said key is depressed.

6. The electronic device of claim 4, further comprising a central platform located between said base and said keycap for pressing said flexible dome when said key is depressed.

7. A low profile keyboard comprising:

a plurality of keyswitches, each keyswitch having a keycap which moves towards a base in response to a keystroke by a user to compress a flexible dome, the flexible dome having a contact surface to engage a base for generating an electrical signal, wherein the improvement comprises:

a dual scissors movement having two scissor structures on each of two sides of said keyswitches, where each scissor structure has a pivot point and at least two arms which pivot about said pivot point, and one or more ends of said arms connected to said key cap and said base layer.

8. The keyboard of claim 7, wherein said dual scissors movement further comprises a living hinge to connect at least one of said arms to said base.

9. The keyboard of claim 7, wherein said dual scissors movement comprises an inner and outer arm member which in combination provides a dual scissors movement for at least two sides of said key.

10. The keyboard of claim 8, wherein said dual scissors movement comprises an inner and outer arm member which in combination provides a dual scissors movement for at least two sides of said key.

11. The keyboard of claim 7, further comprising a central platform located between said base and said keycap for pressing said flexible dome when said key is depressed.

12. The keyboard of claim 8, further comprising a central platform located between said base and said keycap for pressing said flexible dome when said key is depressed.

13. An improved keyswitch guiding mechanism for a low profile keyboard, the keyswitch being the type which includes a finger-engageable keycap movable towards and away from a base to generate an electrical signal in response to the movement of said keycap wherein the improvement comprises:

i. an inner member;

ii. an outer member surrounding said inner member having means for engaging said outer member;

where each inner and outer member includes a living hinge on each of two opposing sides separating each of said two sides into two scissor arms resulting in four inner member scissor arms and four outer member scissor arms, where each scissor arm has a pivot point, and each inner member scissor arm pivots about said pivot points with a corresponding outer member scissor arm.

14. The keyswitch guiding mechanism of claim 13, further comprising a plate connected to said pivot points which moves in a substantially vertical direction with respect to said base to deform a flexible dome to make contact with said base.

15. The keyswitch guiding mechanism of claim 13, wherein said keyswitch guiding mechanism is connected to said base at one of said living hinges.

16. The keyswitch guiding mechanism of claim 15, further comprising a plate connected to said inner member and which moves in a substantially vertical direction with respect to said base to deform a flexible dome to make contact with said base.

17. An improved guiding and constraining mechanism for a light weight, low profile keyswitch, the keyswitch being of the type which includes a finger-engageable keycap movable towards and away from a base to thereby move a resilient member toward and away from the base to engage and disengage contacts carried by the resilient member with conductive paths carried by the base, movement of the keycap being guided and constrained by the mechanism to follow a path substantially perpendicular to the base; wherein the improvement comprises:

a first arm and a second arm, one end of each arm being flexibly connected at a first point;

a third arm and a fourth arm, one end of each arm being flexibly connected at a second point;

a first pivotal connection between the first and third arms, the first pivotal connection being intermediate the free ends of the first and third arms and the first and second points;

a second pivotal connection between the second and fourth arms, the second pivotal connection being intermediate the free end of the second and fourth arms and the first and second points;

means for maintaining the free ends of the first and second arms and the first point in engagement with the keycap: and means for maintaining the free ends of the second and third arms and the second point in engagement with the base.

18. A keyswitch as set forth in claim 17, which further comprises:

a member carried by the pivotal connections and held in engagement with the resilient member for movement toward and away from the base as the keycap is moved.

19. A keyswitch as set forth in claim 18, which further comprises:

means for fixing the first point to the keycap and for fixing the second point to the base.

20. A keyswitch as in claim 17, wherein the arms are made of a plastic material.

21. A keyswitch as in claim 20, wherein:

the first and second arms are integral, the second and third arms are integral, and the flexible connections are living hinges.

* * * * *